US006571757B1

(12) United States Patent
Simpson

(10) Patent No.: US 6,571,757 B1
(45) Date of Patent: Jun. 3, 2003

(54) VARIABLE FORCE SOLENOID WITH SPOOL POSITION FEEDBACK TO CONTROL THE POSITION OF A CENTER MOUNTED SPOOL VALVE TO CONTROL THE PHASE ANGLE OF CAM MOUNTED PHASER

(75) Inventor: Roger Simpson, Ithaca, NY (US)

(73) Assignee: Borgwarner Inc., Auburn Hills, MI (US)

( * ) Notice: Subject to any disclaimer, the term of this patent is extended or adjusted under 35 U.S.C. 154(b) by 0 days.

(21) Appl. No.: 10/281,764

(22) Filed: Oct. 28, 2002

Related U.S. Application Data

(60) Provisional application No. 60/374,329, filed on Apr. 22, 2002.

(51) Int. Cl.[7] ..... F01L 9/04

(52) U.S. Cl. ..... 123/90.11; 123/90.15; 123/90.17; 123/90.12; 123/90.27; 123/90.31; 464/160; 74/568 R

(58) Field of Search ..... 123/90.15, 90.16, 123/90.17, 90.18, 90.12, 90.27, 90.31; 464/1, 2, 160; 74/568 R; 137/312, 625.65

(56) References Cited

U.S. PATENT DOCUMENTS 4,116,321 A * 9/1978 Miller ..... 192/103 F
5,000,420 A * 3/1991 Hendrixon et al. .... 251/129.08
5,088,456 A * 2/1992 Suga ..... 123/90.17
5,106,053 A * 4/1992 Miller et al. ..... 251/129.15
5,150,671 A * 9/1992 Suga ..... 123/90.17
5,167,206 A 12/1992 Suga ..... 123/90.17
5,172,659 A 12/1992 Butterfield et al. ..... 123/90.17
5,184,578 A 2/1993 Quinn, Jr. et al. ..... 123/90.17
5,218,935 A * 6/1993 Quinn et al. ..... 123/90.17
5,271,360 A * 12/1993 Kano et al. ..... 123/90.17
5,497,738 A 3/1996 Siemon et al. ..... 123/90.17
6,408,806 B2 * 6/2002 Sugiyama et al. ..... 123/90.15
6,435,154 B1 * 8/2002 Simpson et al. ..... 123/195 C

* cited by examiner

*Primary Examiner*—Thomas Denion
*Assistant Examiner*—Ching Chang
(74) *Attorney, Agent, or Firm*—Brown & Michaels, PC; Greg Dziegielewski

(57) ABSTRACT

The cam phaser of the present invention includes a variable force solenoid (201) with spool position feedback to control the position of a center mounted spool valve (192) and control the phase angle of the cam mounted phaser. A position sensor (300) is mounted to the spool valve position such that a control loop (30) controls the position of the spool valve (192). A second, outer loop controls the phaser angle. An offset is preferably added to the spool valve position to move the spool valve to its steady state or null position. This null position is required so that the spool (200) can move in to move the phaser in one direction and outward to move the phaser in the other direction. This type of system reduces any frictional or magnetic hysteresis in the spool (200) and solenoid control system.

16 Claims, 3 Drawing Sheets

VARIABLE FORCE SOLENOID WITH SPOOL POSITION FEEDBACK TO CONTROL THE POSITION OF A CENTER MOUNTED SPOOL VALVE TO CONTROL THE PHASE ANGLE OF CAM MOUNTED PHASER

REFERENCE TO RELATED APPLICATIONS

This application claims an invention which was disclosed in Provisional Application No. 60/374,329, filed Apr. 22, 2002, entitled "VARIABLE FORCE SOLENOID WITH SPOOL POSITION FEEDBACK TO CONTROL THE POSITION OF A CENTER MOUNTED SPOOL VALVE TO CONTROL THE PHASE ANGLE OF CAM MOUNTED PHASER". The benefit under 35 USC §119(e) of the United States provisional application is hereby claimed, and the aforementioned application is hereby incorporated herein by reference.

BACKGROUND OF THE INVENTION

1. Field of the Invention

This invention relates to a hydraulic control system for controlling the operation of a variable camshaft timing (VCT) system. More specifically, the present invention relates to a control system which utilizes a position sensor mounted to the spool valve position and a control loop controlling the position of the spool valve.

2. Description of Related Art

U.S. Pat. No. 5,167,206 discloses a helical spline type phaser, which uses a hydraulic piston to move splines axially, which causes the sprocket and cam to move radially. A motion-sensing rod is surrounded by a coil, which forms an electromagnetic pick-up on rod position.

The control system disclosed in both U.S. Pat. Nos. 5,172,659 and 5,184,578 utilizes hydraulic force on both ends of a spool valve. U.S. Pat. No. 5,184,578 shows the control system, in which crank and cam positions are sensed and a Pulse-width Modulated Solenoid moves a spool valve to control the actuation of the phaser, with a closed-loop control measuring the phase difference between cam and crank, and operating the spool valve accordingly.

U.S. Pat. No. 5,497,738 uses a variable force solenoid to control the phase angle using a center mounted spool valve. This type of variable force solenoid can infinitely control the position of the phaser. The force on the end of the vented spool valve located in the center of the phaser is applied by an electromechanical actuator, preferably of the variable force solenoid type, which acts directly upon the vented spool in response to an electronic signal issued from an engine control unit ("ECU") which monitors various engine parameters.

The ECU receives signals from sensors corresponding to camshaft and crankshaft positions and utilizes this information to calculate a relative phase angle. A closed-loop feedback system which corrects for any phase angle error is preferably employed. The use of a variable force solenoid solves the problem of sluggish dynamic response. Such a device can be designed to be as fast as the mechanical response of the spool valve, and certainly much faster than the conventional (fully hydraulic) differential pressure control system. The faster response allows the use of increased closed-loop gain, making the system less sensitive to component tolerances and operating environment.

FIG. 1 shows a block diagram of a further development of the control system shown in U.S. Pat. No. 5,497,738. The Engine Control Unit (ECU) (1) decides on a phase set point (2), based on various demands on the engine and system parameters (temperature, throttle position, oil pressure, engine speed, etc.). The set point is filtered (3) and combined (4) with a VCT phase measurement (12) in a control loop with a PI controller (5), phase compensator (6), and anti-windup logic (7). The output of this loop is combined (9) with a null duty cycle signal (8) into a current driver (10), whose output is combined (13) with a dither signal (11) to provide current (320) to drive the variable force solenoid (VFS)(201). The VFS (201) pushes upon the spool valve (192) which is located in the center of the phaser (14). The spool valve (192), in turn, controls fluid (engine oil) to activate the VCT phaser (14), either by applying oil pressure to the vane chambers or by switching passages to allow cam torque pulses (15) to move the phaser (14), as shown in the patents cited above. The cam position is sensed by a cam sensor (20), and the crank position (or the position of the phaser drive sprocket, which is connected to the crankshaft) is also sensed by sensor (21), and the difference between the two is used by a VCT phase measurement circuit (19) to derive a VCT phase signal (12), which is fed back to complete the loop.

One problem with this system is that the variable force solenoid (201) and the spool valve (192) have both frictional and magnetic hysteresis. This can cause the null position of the spool valve (192) to vary, as the position (310) of the spool valve with increasing current (320) can be different than the position (310) of the spool valve (192) with decreasing current (320). This variable position is shown in graphs (330) and (335) in FIG. 1.

Therefore, there is a need in the art for a system and method which minimizes errors due to hysteresis.

SUMMARY OF THE INVENTION

The cam phaser of the present invention includes a variable force solenoid with spool position feedback to control the position of a center mounted spool valve and control the phase angle of the cam mounted phaser. A position sensor is mounted to the spool valve position such that a control loop controls the position of the spool valve. A second, outer loop controls the phaser angle. An offset is preferably added to the spool valve position to move the spool valve to its steady state or null position. This null position is required so that the spool can move in to move the phaser in one direction and move out to move the phaser in the other direction. This type of system reduces any frictional or magnetic hysteresis in the spool and solenoid control system.

DETAILED DESCRIPTION OF THE INVENTION

The present invention reduces the error created by the prior art by having a position sensor mounted to an armature, or spool valve position, of a variable force solenoid, and a feedback control loop controlling the position of the spool valve. This method reduces any frictional or magnetic hysteresis in the spool and solenoid control system. There is also preferably a second, outer feedback loop to control the phaser angle. The inner loop controls the spool valve position, while the outer loop controls the phase angle. An offset is preferably added to the spool valve position to move the spool valve to its steady state or null position. The null position is required so that the spool can move in to move the phaser in one direction and move out to move the phaser in the other direction. The "phaser" is the variable cam timing (VCT) component which allows the position of the camshaft (126) to be varied in phase relative to the crankshaft (100), also known as a "cam indexer".

The oil in the phaser can leak out many different passages. These include the phaser leakage, inlet port (cam journal bearing), mounting hole, spool valve clearance, and null position leakage. When the cam indexer valve has a "closed null" position to hold a steady position, there is no oil going to the phaser through the ports to replenish the oil that is leaking out. Therefore the valve needs to have the null position very leaky to replenish leakage oil from the engine oil supply. This increased opening (under-lap) now provides a direct path for the oil to flow from chamber to chamber during a reverse torsional (torque effect due to forces on the camshaft), which would allow the phaser to shift position. This also causes increased oscillation from the phaser. So, with the increased leak paths and the under-lap, the chamber volumes need to be increased so that the volume of oil leaking out is a small percentage of the total volume in the phaser.

The present invention design uses an open null spool control valve. The make up oil goes through the check valves directly to the advance and retard chambers. To minimize back drive from the cam torsionals, the check valves prevent reverse oil flow. This, along with minimal leakage in the phaser reduces the overall phaser oscillation. With all the controls in the phaser rotor, response increases and phaser oscillation decreases.

Figure 2:
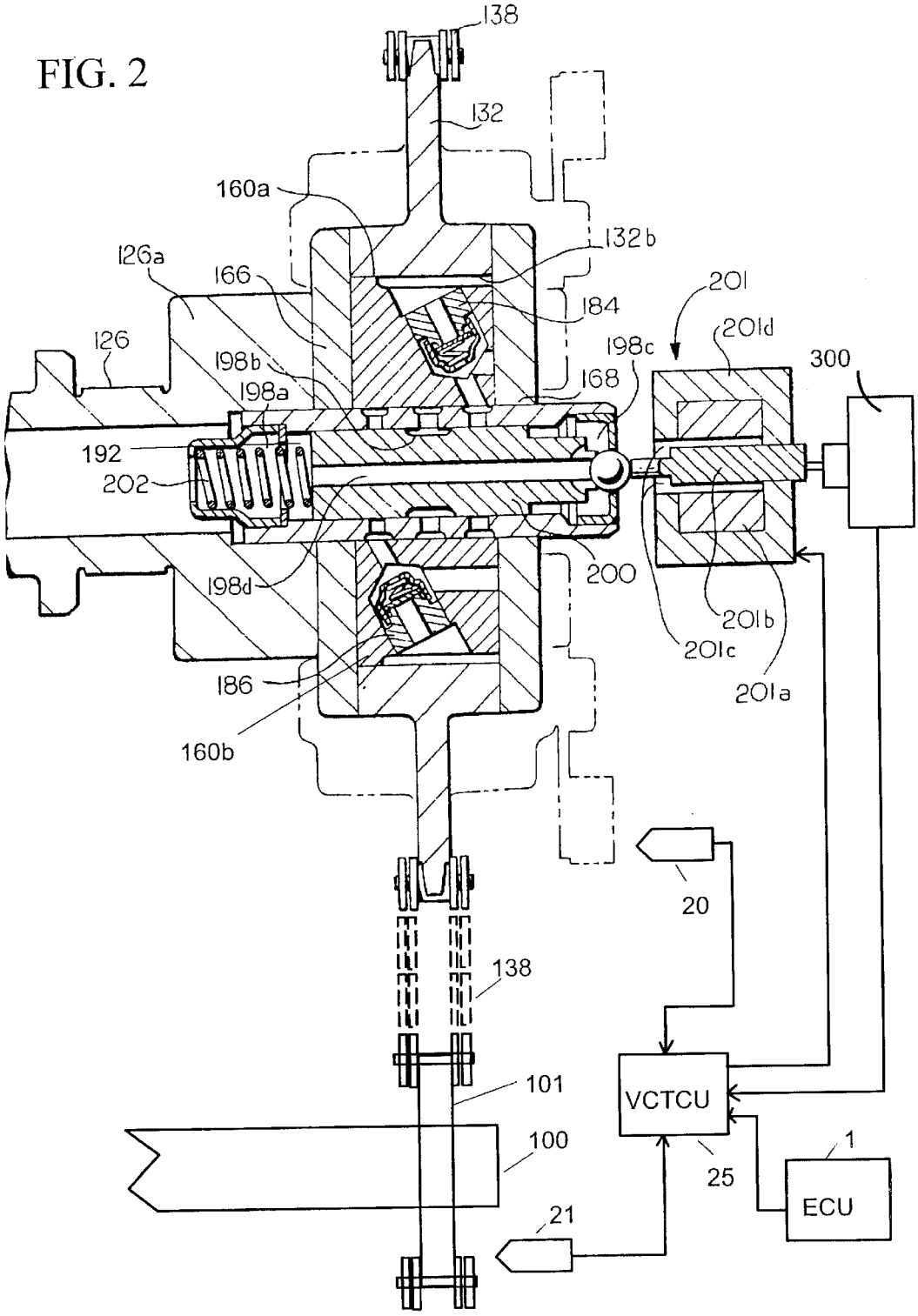
FIG. 2 is a sectional view of a cam phaser with variable force solenoid and position sensor of the invention.

FIG. 2 shows a cam phaser of present invention in which a housing in the form of a sprocket (132) is oscillatingly journalled on a camshaft (126). The camshaft (126) may be considered to be the only camshaft of a single camshaft engine, either of the overhead camshaft type or the in block camshaft type. Alternatively, the camshaft (126) may be considered to be either the intake valve operating camshaft or the exhaust valve operating camshaft of a dual camshaft engine. In any case, the sprocket (132) and the camshaft (126) are rotatable together, and are caused to rotate by the application of torque to the sprocket (132) by an endless roller chain (138), shown fragmentarily, which is trained around the sprocket (132) and also around a crankshaft (100) with its own sprocket (101). As will be hereinafter described in greater detail, the sprocket (132) is oscillatingly journalled on the camshaft (126) so that it is oscillatable at least through a limited arc with respect to the camshaft (126) during the rotation of the camshaft, an action which will adjust the phase of the camshaft (126) relative to the crankshaft (100).

An annular pumping vane is fixedly positioned on the camshaft (126), the vane having a diametrically opposed pair of radially outwardly projecting lobes (160*a*), (160*b*) and being attached to an enlarged end portion (126*a*) of the camshaft (126) by bolts which pass through the vane (160) into the end portion (126*a*). The lobes (160*a*), (160*b*) are received in radially outwardly projecting recesses (132*a*), (132*b*), respectively, of the sprocket (132), the circumferential extent of each of the recesses (132*a*), (132*b*) being somewhat greater than the circumferential extent of the vane lobe (160*a*), (160*b*) which is received in such recess to permit limited oscillating movement of the sprocket (132) relative to the vane (160). The recesses (132*a*), (132*b*) are closed around the lobes (160*a*), (160*b*), respectively, by spaced apart, transversely extending annular plates (166), (168) which are fixed relative to the vane (160), and, thus, relative to the camshaft (126), by bolts which extend from one to the other through the same lobe, (160*a*), (160*b*).

Spool valve (192) is made up of cylindrical member (198) and vented spool (200) which is slidable to and from within cavity (198*a*) as is schematically shown in FIG. 2, where camshaft (126) is being maintained in a selected intermediate position relative to the crankshaft of the associated engine, referred to as the "null" position of spool (200).

Hydraulic fluid, illustratively in the form of engine lubricating oil, flows into the recesses (132*a*), (132*b*) from the spool valve (192) by way of a common inlet line, terminating at a juncture between opposed check valves (184) and (186) which are connected to recesses (132*a*), (132*b*).

In the present invention, the position of vented spool (200) within member (198) is influenced by spring (202) which acts on the end of the spool (200). Thus, spring (202) resiliently urges spool (200) to the right, as oriented in FIG. 2.

The position of spool (200) within member (198) is controlled by an electromechanical actuator (201), preferably a variable force solenoid. A position sensor (300) is mounted so as to sense the position of the solenoid armature (201*b*). An electrical current is introduced through solenoid housing (201*d*) into solenoid coil (201 *a*) which attracts or repels armature (201*b*), causing the armature to move. Armature (20 *b*) bears against vented spool (200), thus moving vented spool (200) to the left, as oriented in FIG. 2. If the force of spring (202) is in balance with the force exerted by armature (201*b*) in the opposite direction, spool (200) will remain in its null or centered position. Thus, vented spool (200) can be moved in either direction by increasing or decreasing the current to solenoid coil (201 *a*), as the case may be. Of course, the configuration of solenoid (201) may be reversed, converting the force on spool extension (200*c*) from a "push" to a "pull" or vice versa. This would require the function of spring (202) to be redesigned to counteract the force in the new direction of armature (201*b*) movement.

The type of solenoid normally used in the preferred embodiment is the cylindrical armature, or variable area, solenoid shown in FIG. 2. Main air gap (201*c*) extends radially around armature (201*b*) and may contain nonmagnetic bearing material. As armature (201*b*) moves axially, the cylindrical area of main gap (201*c*) increases but the force and distance to the coil remain constant. Because the force is relatively insensitive to axial armature position, an extremely precise distance from solenoid housing (201*d*) to vented spool (200) is not required.

The movement of armature (201*b*) is controlled by an electrical current applied to solenoid coil (201 *a*) in response to a control signal either directly from electronic engine control unit (ECU) (1), or, as shown in FIG. 2, from a VCT control unit (25) which receives a phase set point signal from the ECU (1), and does the necessary processing to sense and change the phaser position accordingly.

The VCT control unit (25) of the invention preferably uses as inputs signals from a sensor (21) adjacent to the crankshaft (100) and another sensor (20) adjacent to the phaser or camshaft (126), to sense the relative phase of the camshaft (126) and crankshaft (100). The solenoid sensor (300) forms another input into the VCT control unit (25), which functions as will be explained in connection with FIG. 3, below.

Although the position sensor (300) physically contacts the actuator rod (201*b*) in the figure, physical contact is not necessary. For example, the position sensor (300) could be optically, capacitively or magnetically coupled to the actuator (201*b*), and might be built into the Variable Force Solenoid. Position sensors (300) which could be utilized in this invention include, but are not limited to, linear potentiometers, hall effect sensors, and tape end sensors.

Figure 3:
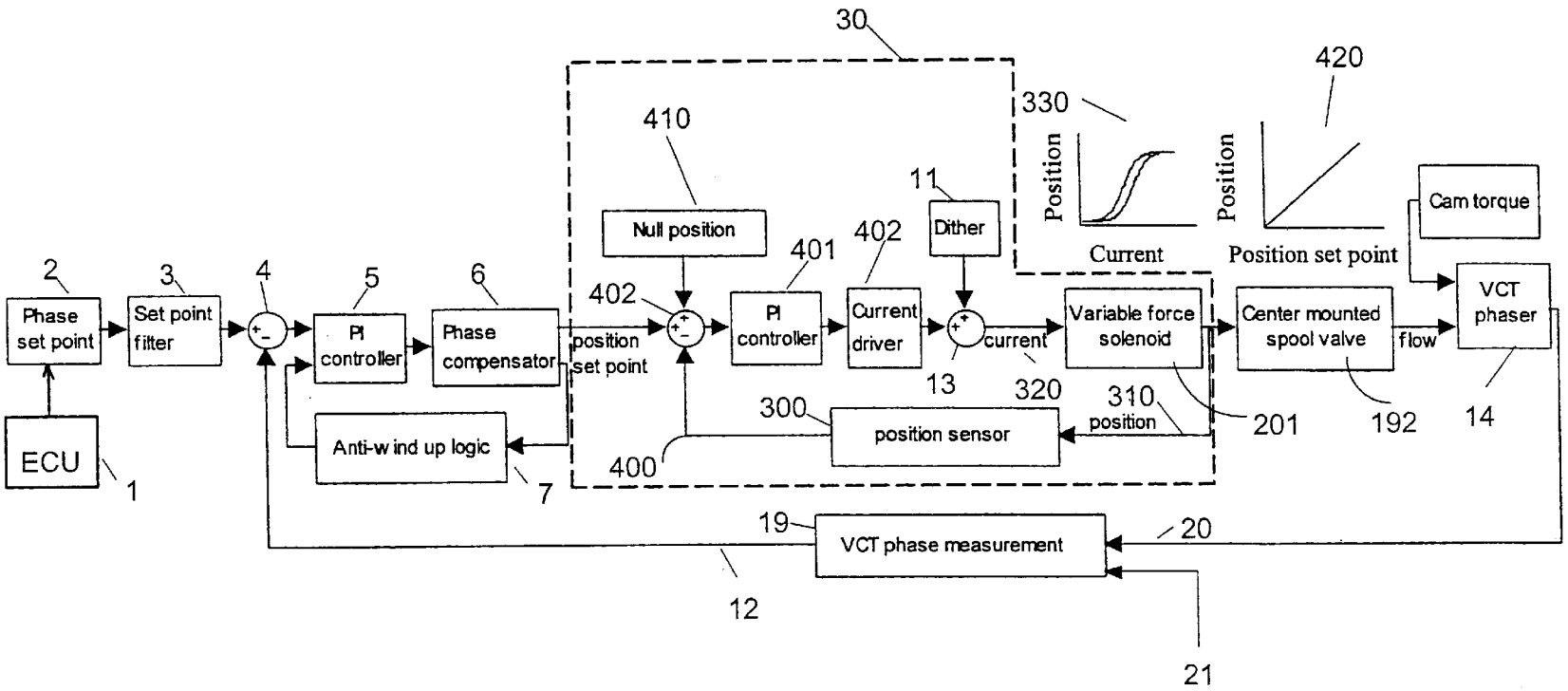
FIG. 3 is a flowchart of a cam torque actuated variable cam timing device with a variable force solenoid and spool valve position feedback of the present invention.

FIG. 3 shows a block diagram of a control circuit of the invention, which uses a feedback loop to control the position of the spool valve, and thereby reduce any frictional or magnetic hysteresis in the spool and solenoid control system. A second feedback loop controls the phaser angle. The inner loop (30) controls the spool valve position and the outer loop (similar to that shown in FIG. 1) controls the phase angle. An offset is preferably added to the spool valve position to move the spool valve to its steady state or null position. This null position is required so that the spool can move in to move the phaser in one direction and outward to move the phaser in the other direction.

Figure 1:
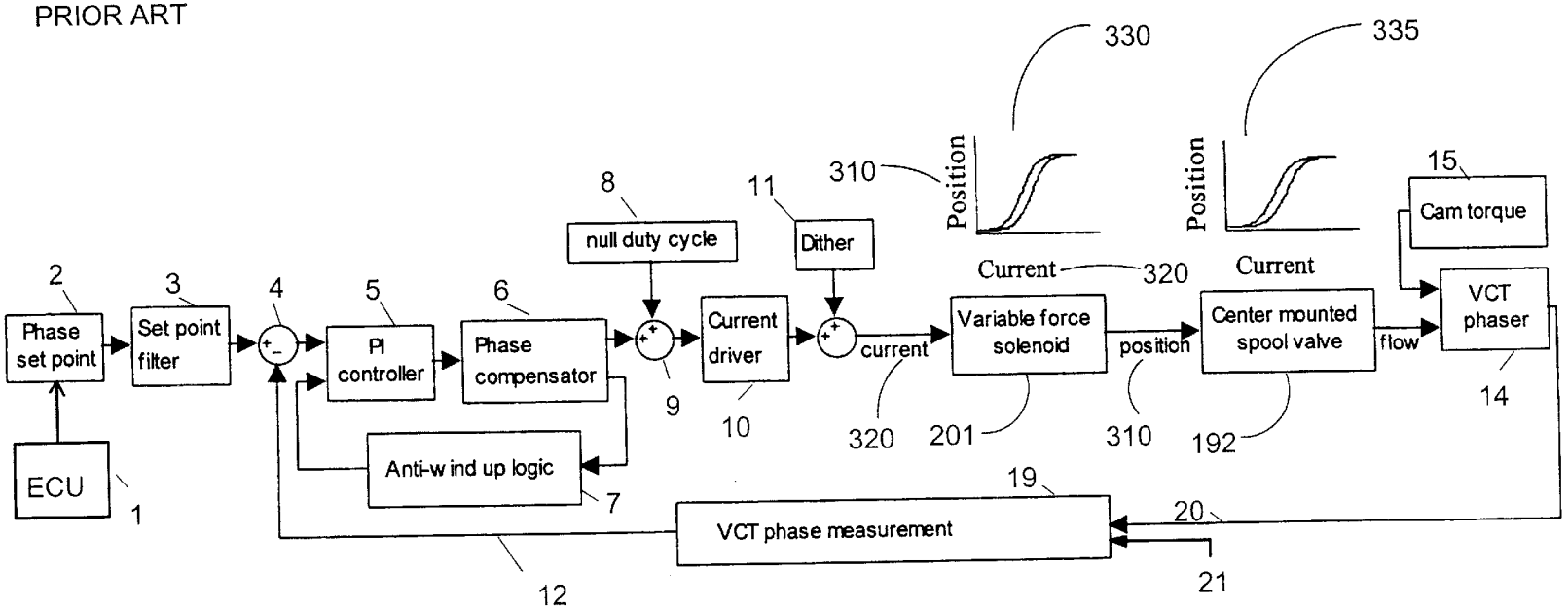
FIG. 1 PRIOR ART
FIG. 1 is a flowchart of a cam torque actuated variable cam timing device with a variable force solenoid.

The basic phaser control loop of FIG. 3 is the same as in FIG. 1, and where the figures are the same, the circuit will not be discussed separately. The difference between the invention shown in FIG. 3 and the prior art of FIG. 1 lies in the inner control loop (30), which starts with the output of phase compensator (6). The output of the compensator (6) is combined (402) with a null position offset (410) and the output (400) of the spool position sensor (300), and input to the PI controller (401) for the inner loop (401). The output of the PI controller (401) is input to a current driver (402), whose output is combined (13) with a dither signal (11), and the resulting current drives the VFS (201). The position of the VFS (201) is read by the position sensor (300), and the output (400) of the position sensor (300) is fed back to complete the loop (30).

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A variable cam timing system for an internal combustion engine having a crankshaft, at least one camshaft, a cam drive connected to the crankshaft, and a variable cam phaser having an inner portion mounted to at least one camshaft and a concentric outer portion connected to the cam drive, the relative angular positions of the inner portion and the outer portion being controllable in response to a fluid control input, such that the relative phase of the crankshaft and at least one camshaft can be shifted by varying the fluid at the fluid control input of the variable cam phaser, the variable cam timing system comprising:

a spool valve (192) comprising a spool slidably mounted in a bore at an axis at a center of the inner portion of the variable cam phaser, the bore having a plurality of passages coupled to the fluid control input of the variable cam phaser, such that axial movement of the spool in the bore controls fluid flow at the fluid control input of the variable cam phaser;

a variable force solenoid (201) having an electrical input and an armature (201*b*) coupled to the spool, such that an electrical signal at the electrical input causes movement of the armature, causing the spool to move axially in the bore;

a position sensor (300) coupled to the armature, having a position signal output representing the physical position of the armature;

VCT phase measurement sensors (20)(21) coupled to the crankshaft and the at least one camshaft controlled by the variable cam timing system;

a VCT control circuit comprising:

a cam phase input coupled to the VCT phase measurement sensors;

a phase set point input for accepting a signal representing a desired relative phase of the camshaft and crankshaft;

a solenoid position input coupled to the position signal output; and a solenoid drive output coupled to the electrical input of the variable force solenoid;

a signal processing circuit accepting signals from the phase set point input, cam phase input, and solenoid position input and outputting to the solenoid drive output such that when a phase set point signal is applied at the phase set point input, the control circuit provides an electrical signal at the solenoid drive output to cause the variable force solenoid to move the spool to control the variable cam phaser to shift the phase of the camshaft as selected by the phase set point signal.

2. The variable cam timing system of claim 1, wherein the position sensor (300) is selected from the group consisting of a linear potentiometer, a hall effect sensor, and a tape end sensor.

3. The variable cam timing system of claim 1, wherein the armature and the position sensor are coupled by a means selected from the group consisting of a physical coupling, an optical coupling, a magnetic coupling, and a capacitive coupling.

4. The variable cam timing system of claim 1, wherein the fluid comprises engine lubricating oil from a pressurized lubricating oil source.

5. The variable cam timing system of claim 1, in which the signal processing circuit comprises:

an outer loop for controlling the phase angle, coupled to the set point input, cam phase input, and solenoid drive output;

an inner loop for controlling the spool valve position, coupled to the solenoid position input and to the inner loop;

such that the solenoid drive output as set by the outer loop is modified by the inner loop based on the solenoid position.

6. The variable cam timing system of claim 5, in which:

a) the outer loop comprises:

i) an anti-windup loop comprising:

A) a first PI controller (5) having a first input coupled to the set point input; a second input coupled to the cam phase input; a third input and an output;

B) a phase compensator (6) having an input coupled to the output of the first PI controller and a first output and a second output; and C) anti-windup logic (7) having an input coupled to the second output of the phase compensator and an output coupled to the third input of the PI controller;

ii) a combiner (402) having a first input coupled to a null position offset signal (410), a second input coupled to the output of the phase compensator, a third input, and an output;

iii) a second PI controller (401) having an input coupled to the output of the combiner and an output; and iv) a current driver (402) having an input coupled to the output of the second PI controller and an output coupled to the solenoid drive output;

b) the inner loop comprises coupling the solenoid position input to the third input of the combiner.

7. The variable cam timing system of claim 6, further comprising a dither signal (11) coupled to the solenoid drive output.

8. An internal combustion engine comprising:

a) a crankshaft;

b) at least one camshaft;

c) a cam drive connected to the crankshaft;

d) a variable cam phaser having an inner portion mounted to at least one camshaft and a concentric outer portion connected to the cam drive, where relative angular positions of the inner portion and the outer portion being controllable in response to a fluid control input, such that the relative phase of the crankshaft and at least one camshaft can be shifted by varying the fluid at the fluid control input of the variable cam phaser; and e) a variable cam timing system comprising:

i) a spool valve (192) comprising a spool slidably mounted in a bore at an axis at a center of the inner portion of the variable cam phaser, the bore having a plurality of passages coupled to the fluid control input of the variable cam phaser, such that axial movement of the spool in the bore controls fluid flow at the fluid control input of the variable cam phaser;

ii) a variable force solenoid (201) having an electrical input and an armature (201*b*) coupled to the spool, such that an electrical signal at the electrical input causes movement of the armature, causing the spool to move axially in the bore;

iii) a position sensor (300) coupled to the armature, having a position signal output representing the physical position of the armature;

iv) VCT phase measurement sensors (20)(21) coupled to the crankshaft and the at least one camshaft controlled by the variable cam timing system;

v) a VCT control circuit comprising:

a cam phase input coupled to the VCT phase measurement sensors;

a phase set point input for accepting a signal representing a desired relative phase of the camshaft and crankshaft;

a solenoid position input coupled to the position signal output; and a solenoid drive output coupled to the electrical input of the variable force solenoid;

a signal processing circuit accepting signals from the phase set point input, cam phase input, and solenoid position input and outputting to the solenoid drive output such that when a phase set point signal is applied at the phase set point input, the control circuit provides an electrical signal at the solenoid drive output to cause the variable force solenoid to move the spool to control the variable cam phaser to shift the phase of the camshaft as selected by the phase set point signal.

9. The internal combustion engine of claim 8, wherein the position sensor (300) is selected from the group consisting of a linear potentiometer, a hall effect sensor, and a tape end sensor.

10. The internal combustion engine of claim 8, wherein the armature and the position sensor are coupled by a means selected from the group consisting of a physical coupling, an optical coupling, a magnetic coupling, and a capacitive coupling.

11. The internal combustion engine of claim 8, wherein the fluid comprises engine lubricating oil from a pressurized lubricating oil source.

12. The internal combustion engine of claim 8, in which the signal processing circuit comprises:

an outer loop for controlling the phase angle, coupled to the set point input, cam phase input, and solenoid drive output;

an inner loop for controlling the spool valve position, coupled to the solenoid position input and to the inner loop;

such that the solenoid drive output as set by the outer loop is modified by the inner loop based on the solenoid position.

13. The internal combustion engine of claim 12, in which:

a) the outer loop comprises:

i) an anti-windup loop comprising:

A) a first PI controller (5) having a first input coupled to the set point input; a second input coupled to the cam phase input; a third input and an output;

B) a phase compensator (6) having an input coupled to the output of the first PI controller and a first output and a second output; and C) anti-windup logic (7) having an input coupled to the second output of the phase compensator and an output coupled to the third input of the PI controller;

ii) a combiner (402) having a first input coupled to a null position offset signal (410), a second input coupled to the output of the phase compensator, a third input, and an output;

iii) a second PI controller (401) having an input coupled to the output of the combiner and an output; and iv) a current driver (402) having an input coupled to the output of the second PI controller and an output coupled to the solenoid drive output;

b) the inner loop comprises coupling the solenoid position input to the third input of the combiner.

14. The internal combustion engine of claim 13, further comprising a dither signal (11) coupled to the solenoid drive output.

15. In an internal combustion engine having a variable camshaft timing system for varying the phase angle of a camshaft relative to a crankshaft, a method of regulating the flow of fluid from a source to a means for transmitting rotary movement from the crankshaft to a housing, comprising the steps of:

sensing the positions of the camshaft and the crankshaft;

calculating a relative phase angle between the camshaft and the crankshaft, the calculating step using an engine control unit for processing information obtained from the sensing step, the engine control unit further issuing a electrical signal corresponding to the phase angle;

controlling the position of a vented spool slidably positioned within a spool valve body, the controlling step being in response to the signal received from the engine control unit, the controlling step utilizing an electromechanical actuator to vary the position of the vented spool and a position sensor to sense a position of the spool, wherein the electromechanical actuator comprises a variable force solenoid;

supplying fluid from the source through the spool valve to a means for transmitting rotary movement to the camshaft, the spool valve selectively allowing and blocking flow of fluid through an inlet line and through return lines; and transmitting rotary movement to the camshaft in such a manner as to vary the phase angle of the camshaft with respect to the crankshaft, the rotary movement being transmitted through a housing, the housing being mounted on the camshaft, the housing further being rotatable with the camshaft and being oscillatable with respect to the camshaft.

16. The method of claim 15, wherein the position sensor is selected from the group consisting of a linear potentiometer, a hall effect sensor, and a tape end sensor.

* * * * *